US008305387B2

(12) United States Patent
Russell et al.

(10) Patent No.: US 8,305,387 B2
(45) Date of Patent: Nov. 6, 2012

(54) ADAPTIVE PULSE-WIDTH MODULATED SEQUENCES FOR SEQUENTIAL COLOR DISPLAY SYSTEMS

(75) Inventors: Andrew Ian Russell, Plano, TX (US); David Foster Lieb, Dallas, TX (US); Jeffrey Matthew Kempf, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1167 days.

(21) Appl. No.: 11/851,921

(22) Filed: Sep. 7, 2007

(65) Prior Publication Data

US 2009/0066620 A1 Mar. 12, 2009

(51) Int. Cl.
*G09G 5/02* (2006.01)

(52) U.S. Cl. ..... 345/589; 345/595; 345/616; 345/88; 382/251; 382/252; 382/254

(58) Field of Classification Search ..... 345/589, 345/595, 616, 88; 382/251, 252, 254; 353/31; 348/811, 742, 743, 771, 505
See application file for complete search history.

(56) References Cited

U.S. PATENT DOCUMENTS

| | | | | |
|---|---|---|---|---|
| 5,337,068 | A * | 8/1994 | Stewart et al. | 345/88 |
| 5,387,931 | A * | 2/1995 | Yagi et al. | 348/223.1 |
| 6,181,367 | B1 * | 1/2001 | McGrew et al. | 348/41 |
| 6,419,342 | B1 * | 7/2002 | Bronswijk et al. | 347/19 |
| 6,683,290 | B2 | 1/2004 | Doherty | |
| 6,724,354 | B1 | 4/2004 | Spitzer et al. | |
| 6,980,177 | B2 * | 12/2005 | Struyk | 345/8 |
| 7,088,321 | B1 | 8/2006 | Parker | |
| 7,576,759 | B2 * | 8/2009 | Pettitt et al. | 345/691 |
| 2005/0128441 | A1 | 6/2005 | Morgan | |
| 2005/0243282 | A1 | 11/2005 | Peterson et al. | |
| 2006/0050185 | A1 * | 3/2006 | Willis | 348/743 |
| 2006/0232717 | A1 | 10/2006 | Kervee et al. | |
| 2007/0058143 | A1 * | 3/2007 | Penn et al. | 353/102 |
| 2007/0242090 | A1 * | 10/2007 | Struyk | 345/690 |

* cited by examiner

*Primary Examiner* — Said Broome
*Assistant Examiner* — Abderrahim Merouan
(74) *Attorney, Agent, or Firm* — Warren L. Franz; Wade J. Brady, III; Frederick J. Telecky, Jr.

(57) ABSTRACT

Adaptive pulse-width modulated sequences for sequential color display systems and methods. A method for displaying an image comprises receiving the image, computing a duty cycle for the image, generating a color sequence based on the computed duty cycle, and displaying the image using the color sequence. The generating comprises assigning a color cycle order to display time blocks in the color sequence, and assigning bitplane states for each display time block in the color sequence.

21 Claims, 7 Drawing Sheets

ADAPTIVE PULSE-WIDTH MODULATED SEQUENCES FOR SEQUENTIAL COLOR DISPLAY SYSTEMS

RELATED PATENT APPLICATION

Related subject Matters appears in application Ser. No. 11/851,916, entitled "System and Method for Image-based Color Sequence Reallocation," filed Sep. 7,2009,which is hereby incorporated herein by reference.

TECHNICAL FIELD

The present invention relates generally to a system and method for displaying images, and more particularly to adaptive pulse-width modulated sequences for sequential color display systems and methods.

BACKGROUND

Sequential color display systems generally display colors one at a time. For example, in a three-color RGB sequential color display system, a first color displayed may be red (R), followed by a second color, such as green (G), and then followed by a third color, such as blue (B). The three-color RGB sequential color display system may then continually repeat the RGB color sequence or display a different color sequence, such as BGR, RBG, and so on. The sequentially displayed colors may then be used to display images.

In a sequential color display system using a microdisplay commonly referred to as a digital micromirror device (DMD), image data corresponding to a color of light being displayed may be provided to the DMD. The image data may be used to set micromirror state (position), wherein when a micromirror is in a first state, the light may be reflected onto a display plane and when a micromirror is in a second state, the light may be reflected away from the display plane. When a different color of light is being displayed, image data corresponding to the different color of light may be provided to the DMD. A viewer's visual system generally will integrate the sequentially displayed image data into color images.

A color sequence may be designed so that colored light of various intensities (brightness) may be displayed, enabling the displaying of generally the entirety of a range of light intensities displayable by the sequential color display system. For example, a color sequence may contain a binary weighted sequence of light intensities, ranging from a light intensity of about $2^0$ to a light intensity of about $2^N$, wherein $2^{N+1}$-1 is the brightest intensity of light for a given color of light producible by the sequential color display system. When there is a need to display a light of a desired intensity on the display plane, light modulators in the microdisplay may be configured to direct a combination of the appropriate light intensities onto the display plane. For example, if there is a need to display a light intensity of 19 (binary 10011) in a DMD-based sequential color display system, then a micromirror may be configured to be in the first state (to reflect light onto the display plane) when the color sequence specifies that light intensities of $2^0$, $2^1$, and $2^4$ are provided by the light source. The viewer's visual system may then integrate the three light intensities into a single light intensity of 19.

However, the ordering and duration of the colors displayed in a color sequence may have an impact on the quality of the images being displayed. For instance, if the ordering of the colors in a color sequence is such that the color cycle rate is low, then color separation artifacts may be visible. Additionally, pulse-width modulation artifacts may be visible if durations of blocks of colored light are not well distributed over the entirety of a color sequence. Furthermore, pulse-width modulation artifacts may be visible if the distribution of colors in consecutive color sequences changes dramatically. Both of these artifacts may have a negative impact on the quality of the displayed images.

SUMMARY OF THE INVENTION

These and other problems are generally solved or circumvented, and technical advantages are generally achieved, by embodiments of adaptive pulse-width modulated sequences for sequential color display systems and a system therefor.

In accordance with an embodiment, a method for displaying an image is provided. The method includes receiving the image, computing a duty cycle based on the display color intensities, generating a color sequence based on the duty cycle, and displaying the image using the color sequence. The generating includes assigning a color cycle order to display time blocks in the color sequence, and assigning bitplane states for each display time block in the color sequence.

In accordance with another embodiment, a method for generating a color sequence is provided. The method includes assigning a color to be provided by a light source to each first display time block in a set of first display time blocks of the color sequence, assigning a color to be provided by a light source to each second display time block in a set of second display time blocks of the color sequence, assigning an on-time for a specified color of light associated with a third display time block in a set of third display time blocks of the color sequence, and providing the color sequence to a light source to provide light for use in displaying an image. A color assigned to a first display time block in the set of first display time blocks and a color assigned to a second display time block in the set of second display time blocks are assigned during run-time, and a specified color is assigned to a corresponding third display time block before run-time.

In accordance with another embodiment, a display system is provided. The display system includes a light source, a light modulator optically coupled to the light source and positioned in a light path of the light source, an input providing an image to display, and a controller electronically coupled to the light modulator and the light source. The light modulator produces images on a display plane by modulating light from the light source based on image data, and the controller loads image data into the light modulator and to provide a color sequence to the light source, the controller includes a sequence generator that assigns a color cycle order to the color sequence and assigns bitplane states for image data An advantage of an embodiment is that a single color sequence design may be used to provide adaptive pulse-width modulated color sequences for use in sequential color display systems. The use of a single color sequence design may simplify implementation requirements as well as reduce storage requirements. The single color sequence design may be used to provide simple changes to color sequence percentages (duty cycles) on a frame-by-frame basis.

Another advantage of an embodiment is that the single color sequence design allows for real-time optimization of the color sequence percentages (duty cycles) of the colors in the color sequence, enabling an increase in image brightness, and thereby increasing the quality of the displayed images.

The foregoing has outlined rather broadly the features and technical advantages of the present invention in order that the detailed description of the embodiments that follow may be better understood. Additional features and advantages of the embodiments will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The embodiments will be described in a specific context, namely a DMD-based sequential color display system. The invention may also be applied, however, to other sequential color display systems, such as microdisplay-based projection display systems that use sequential colors, such as projection display systems utilizing deformable micromirrors, transmissive and reflective liquid crystal, liquid crystal on silicon, ferroelectric liquid-crystal-on-silicon, and so forth, microdisplays. Furthermore, the invention may be applied to direct-view sequential color display systems, such as some liquid crystal displays.

Figure 1A:
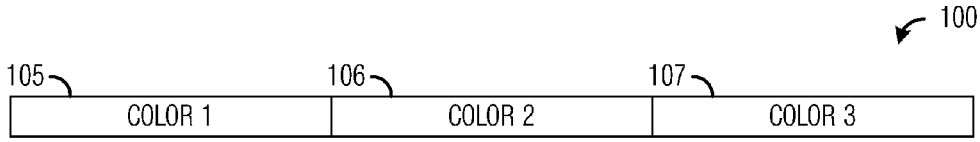
FIG. 1*a* is a diagram of an exemplary color sequence.

With reference now to FIG. 1*a*, there is shown a diagram illustrating an exemplary color sequence 100. The color sequence 100 displays an amount of time allocated to each color in the color sequence. As shown, the color sequence 100 includes three colors, a first color display time "color 1" 105, a second color display time "color 2" 106, and a third color display time "color 3" 107. As shown, the time of the color sequence 100 may be substantially evenly distributed between the three colors. However, color sequences may exist wherein the time of the color sequences is not evenly distributed between the colors in the color sequence. For example, if one particular color's light source is dimmer than the light source of the other colors, the time allocated to the dim color may be longer than the time allocated to the colors with more powerful light sources. In general, the time allocated to the colors in the color sequence may be dependent on factors such as color source power, desired color point, operating environment, and so forth.

Figure 1B:
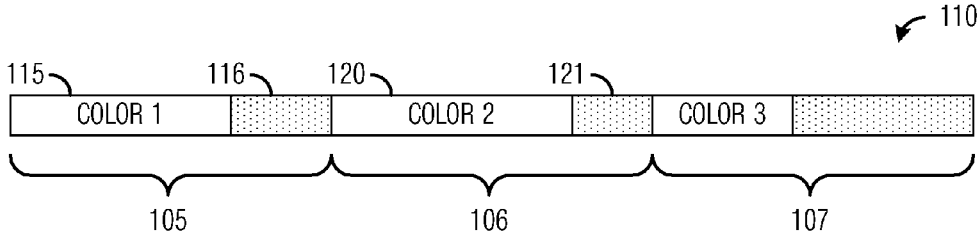
FIGS. 1*b* and 1*c* are diagrams of unused color display time in the exemplary color sequence shown in FIG. 1*a;*
Figure 1C:
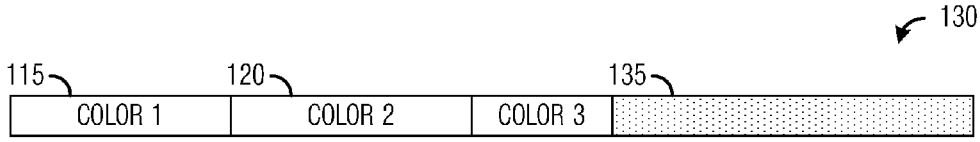

FIG. 1*b* illustrates a color sequence 110 with portions of the color display time actually used to display image data highlighted. Although a color sequence, such as the color sequence 100, may result in a providing of the colors in the color sequence 100 by a light source for a specified amount of time, depending on the image being displayed, not all of the colored light being provided by the light source may be used to display image data. As shown in the color sequence 110, in a duration dedicated to the providing of color 1, the first color display time 105, only a first portion of the first color display time 105 (shown as highlight 115) may be used to display image data while a second portion of the first color display time 105 (shown as highlight 116) may be left unused. Similarly, a third portion (highlight 120) of the display time for the display of color 2 may be used with a fourth portion (highlight 121) being left unused. FIG. 1*c* illustrates a reorganized color sequence 130 with the portions of the display time of colored light being moved to a beginning of the color sequence 130 and an unused display time (highlight 135) that may be a combination of the unused display times for each of the colors in the color sequence 110.

In a DMD-based sequential color display system, because colored light provided by a light source during the unused display time 135 is reflected away from a display plane, the image displayed using the color sequence 100 may be visually identical to the image displayed with color sequence 130.

Figure 2:
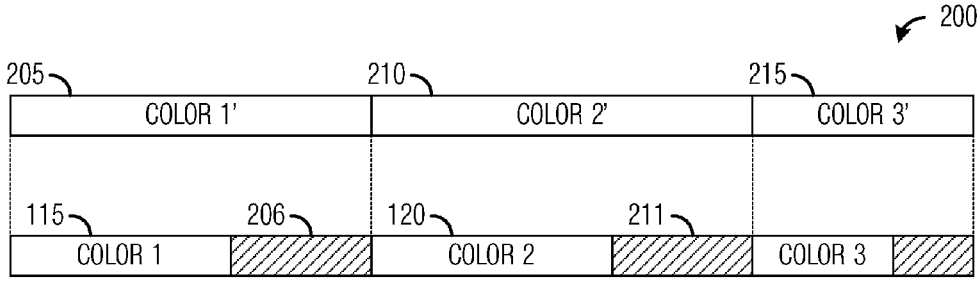
FIG. 2 is a diagram of an adjusted color sequence.

It may be possible to allocate some or all of the unused display time 135 to colors of light actually being used to display image data. This may result in displayed images with greater brightness and better image quality. FIG. 2 displays a reallocated color sequence 200 wherein the display time has been reallocated so that unused colors of light are not provided by the light source while their formerly allocated display times have been reassigned to the providing of colors of light that are used to display image data. The reallocated color sequence 200 includes display times for color 1' 205, color 2' 210, and color 3' 215. The display time for color 1' 205 comprises the first color display time 115 plus a portion of the unused display time 135 (shown as highlight 206). Similarly, the display time for color 2' 210 comprises the second color display time 120 plus a portion of the unused display time 135 (highlight 211).

The amount of the unused display time 135 reallocated to the display of each of the colors in the color sequence may be performed so as to meet selected constraints or objectives, for example, the reallocation of the unused display time 135 may be performed so that the color point of the image is preserved. In general, the unused display time 135 preferably is not simply partitioned equally to the display time for each color of the color sequence, although it could be.

Figure 3:
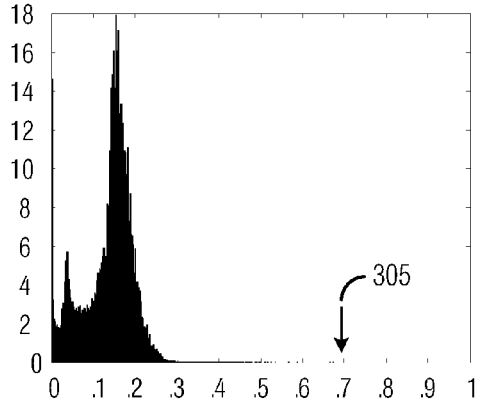
FIG. 3 is a diagram of a histogram of a color of an image.

The unused display time 135 may arise from the color sequence providing all displayable intensities for each color used in the sequential color display system. However, not all images will make use of the entire range of displayable intensity of a color. For example, in dim images with a significant percentage of black or gray, the vast majority of pixels may have light intensities significantly below 25 to 30 percent of a maximum intensity. FIG. 3 displays a histogram of pixels from an exemplary image for a single color, for example, the color red. The histogram shows that more than 95 percent of the pixels have a light intensity that is less than 0.30 of the maximum intensity and no pixel has a light intensity greater than 0.70 of the maximum intensity (shown as pointer 305). Therefore, a color sequence that specifies the providing of red colored light by a light source with intensities greater than 0.70 of the maximum intensity may be wasting valuable display time. The display time dedicated to the providing of light with intensities greater than required in the display of an image may be reallocated to the providing of light with intensities within a useful range, typically less than a maximum light intensity actually used in the displaying of the image, thereby increasing the overall brightness of the image being displayed.

Figure 4A:
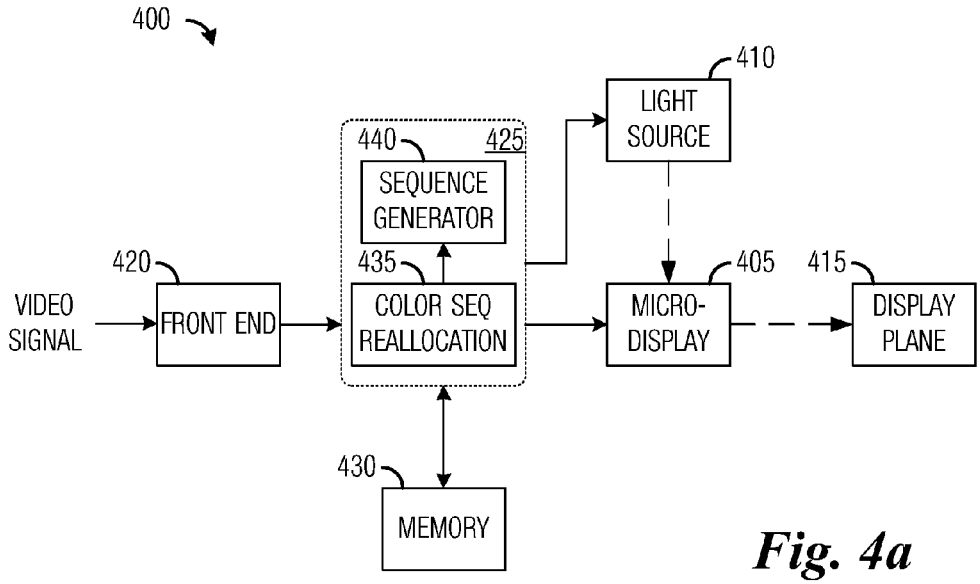
FIG. 4*a* is a diagram of a sequential color display system.

FIG. 4*a* illustrates a high level view of a microdisplay-based sequential color projection display system 400, wherein the microdisplay-based sequential color projection display system 400 dynamically performs scene-based color sequence reallocation. The microdisplay-based sequential color projection display system 400 utilizes an array of light modulators, more specifically, a microdisplay 405, wherein individual light modulators in the microdisplay 405 assume a state corresponding to image data for an image being displayed by the microdisplay-based sequential color projection display system 400. The microdisplay 405 is preferably a digital micromirror device (DMD) with each light modulator being a positional micromirror. For example, in a DMD-based sequential color projection display system 400, light from a light source 410 may either be reflected away from or towards a display plane 415 based on image data of an image being displayed. A combination of the reflected light from the light modulators in the DMD 405 produces an image corresponding to the image data. Other examples of microdisplays may include deformable micromirrors, transmissive and reflective liquid crystal, liquid crystal on silicon, ferroelectric liquid-crystal-on-silicon, and so forth.

A front end unit 420 may perform operations such as converting analog input signals into digital, Y/C separation, automatic chroma control, automatic color killer, and so forth, on an input video signal. The front end unit 420 may then provide the processed video signal, which may contain image data from images to be displayed to a controller 425. The controller 425 may be an application specific integrated circuit (ASIC), a general purpose processor, and so forth, may be used to control the general operation of the projection display system 400. In additional to controlling the operation of the microdisplay-based sequential color projection display system 400, the controller 425 may be used to process the signals provided by the front end unit 420 to help improve image quality. For example, the controller 425 may be used to perform color correction, adjust image bit-depth, color space conversion, and so forth. A memory 430 may be used to store image data, sequence color data, and various other information used in the displaying of images.

The controller 425 may include a color sequence reallocation unit 435 that may be used to reallocate display times for different colors of light in a color sequence based on an image-by-image basis. The color sequence reallocation unit 435 may perform an analysis of the pixels in an image and adjust the different colors of light in the image so that colors of light not needed in the displaying of the image are not displayed. For example, if a color sequence may allow for the displaying of various intensities of a given color, ranging from intensity zero to intensity 100, and, if in the image, a maximum needed intensity in the given color is 72, then the color sequence may be adjusted so that intensities 73 through 100 for the color are not displayed. Furthermore, the display times for the intensities 73 through 100 may be reallocated to other colors in the color sequence on an as needed basis.

The controller 425 may also include a sequence generator 440 that may be used to generate (or select) a color sequence to produce and display the colors as reallocated by the color sequence reallocation unit 435. For example, the sequence generator 440 may receive a description of the reallocated color sequence (or the actual reallocated color sequence) and create light control commands that may be provided to the light source 410. The light control commands may be directly provided to the light source 410 so that the light source 410 may produce the desired colors of light, or the light control commands may be provided to a light driver unit that may convert the light control commands into drive currents that may be provided to the light source 410. Alternatively, the sequence generator 440 may use the description of the reallocated color sequence and retrieve light control commands that match (or closely match) the description of the reallocated color sequence from a memory, such as the memory 430.

Figure 4B:
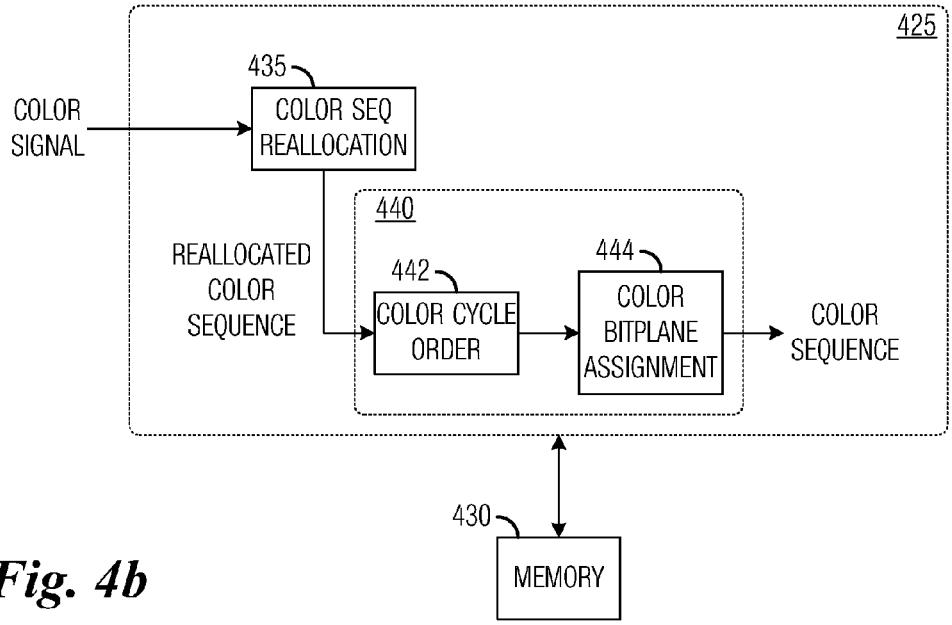
FIG. 4*b* is a diagram of a controller of a sequential color display system.

FIG. 4*b* illustrates a detailed view of the controller 425 with emphasis provided on the color sequence reallocation unit 435 and the sequence generator 440. A color signal provided by the front end unit 420 may contain color information from an image being displayed. The color signal may be provided to the color sequence reallocation unit 435 of the controller 425. The color sequence reallocation unit 435 may be used to determine a maximum intensity for each color used in the displaying of the image.

In many instances, a significant majority of pixels of an image may be concentrated below a certain light intensity level with a much smaller number of pixels of the image having higher light intensity levels. An example of this behavior may be seen in the histogram shown in FIG. 3, wherein more than 95 percent of the pixels have a light intensity of less than 0.30 of the maximum intensity, while no pixel has a light intensity of more than 0.70 of the maximum intensity. Therefore, if a specified percentage of the pixels are allowed to clip, it may be possible to further reduce the maximum intensity for each color used in the displaying of the image. When a pixel is clipped, it may be displayed as a full intensity pixel rather than its actual intensity, wherein the full intensity is whatever has been determined as a maximum displayed intensity. For example, if the full intensity selected for the pixels shown in FIG. 3 is at 0.60 of the maximum intensity, then the pixels with intensity greater than 0.60 of the maximum intensity may be clipped and may be displayed at the full intensity level (0.60 of the maximum intensity). The clipping may be an optional operation since some image information is lost, which may impact image quality. However, if the clipping is set at a low level so that a relatively small number of pixels is affected, then the impact on image quality may be very hard to detect visually.

The color sequence reallocation unit 435 may also reallocate the display times for each color in the color sequence. The reallocation of display times in the color sequence may be based on a difference between the maximum intensity for each color used in the displaying of the image and the maximum light intensity for each color producible by the micro-display-based sequential color projection display system 400. If the maximum intensity for a given color in the image is less than the maximum light intensity producible by the micro-display-based sequential color projection display system 400 for the given color, then the display time for the given color spent producing intensities greater than the maximum intensity for a given color in the image is wasted. The color sequence reallocation unit 435 may adjust the color sequence so that the color sequence may produce a maximum intensity that may be substantially equal to the maximum intensity for a given color in the image. Thereby, the formerly wasted display time may be devoted to displaying colors that may be used in displaying the image.

Figure 5A:
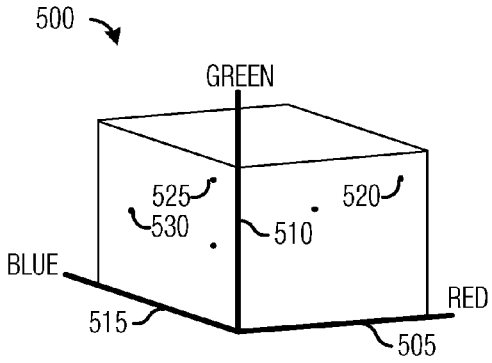
FIGS. 5*a* and 5*b* are diagrams of a color-cube of a three-color RGB sequential color display system.

FIG. 5*a* illustrates a color-cube 500 representing the displayable colors in a three-color RGB sequential color display system. Each of the three colors may be represented by an axis originating at a corner of the color-cube 500, with a first axis 505 representing the color red, a second axis 510 representing the color green, and a third axis 515 representing the color blue. The intensities of each of the three colors increase as the distance from an origin of the axes increases. A maximum intensity for each color is represented by the edges of the color-cube 500. Shown in the color-cube 500 are some pixels representing image data, such as pixel 520, 525, 530. The pixels may be internal to the color-cube 500 or on a surface of the color-cube 500, depending on the image data.

Figure 5B:
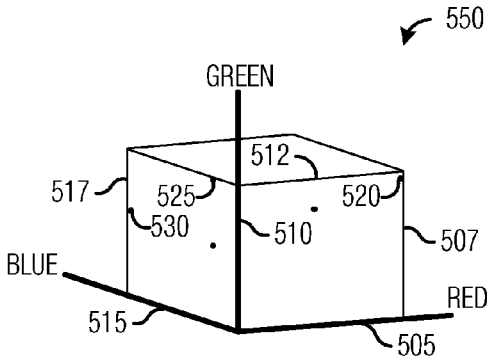

Since none of the pixels shown in FIG. 5*a* are along an edge of the color-cube 500, none of the pixels require the three-color RGB sequential color display system to display its entire range of light intensities. Therefore, it may be possible for the three-color RGB sequential color display system to adjust its color sequence so that the maximum displayed light intensity may correspond to a maximum light intensity required by the image data of the image. FIG. 5*b* illustrates a color-cube 550 wherein the color-cube 550 has been adjusted so that the maximum light intensity displayed by the three-color RGB sequential color display system corresponds to the maximum light intensity required by the image data. The edges of the color-cube 550 have been moved towards the origin of the color-cube 550 so that the edges are about equal to pixels of the image that require maximum light intensity. For example, edge 507 corresponding to a maximum light intensity for the color red, may be moved in towards pixel 520. Similarly, edge 512 (a maximum light intensity for the color green) may be moved in towards pixel 525, and edge 517 (a maximum light intensity for the color blue) may be moved in towards pixel 530. The values of the edges 507, 512, and 517, may now correspond to a maximum displayed light intensity for an adjusted color sequence that may be used to display the pixels 520, 525, and 530.

Figure 5C:
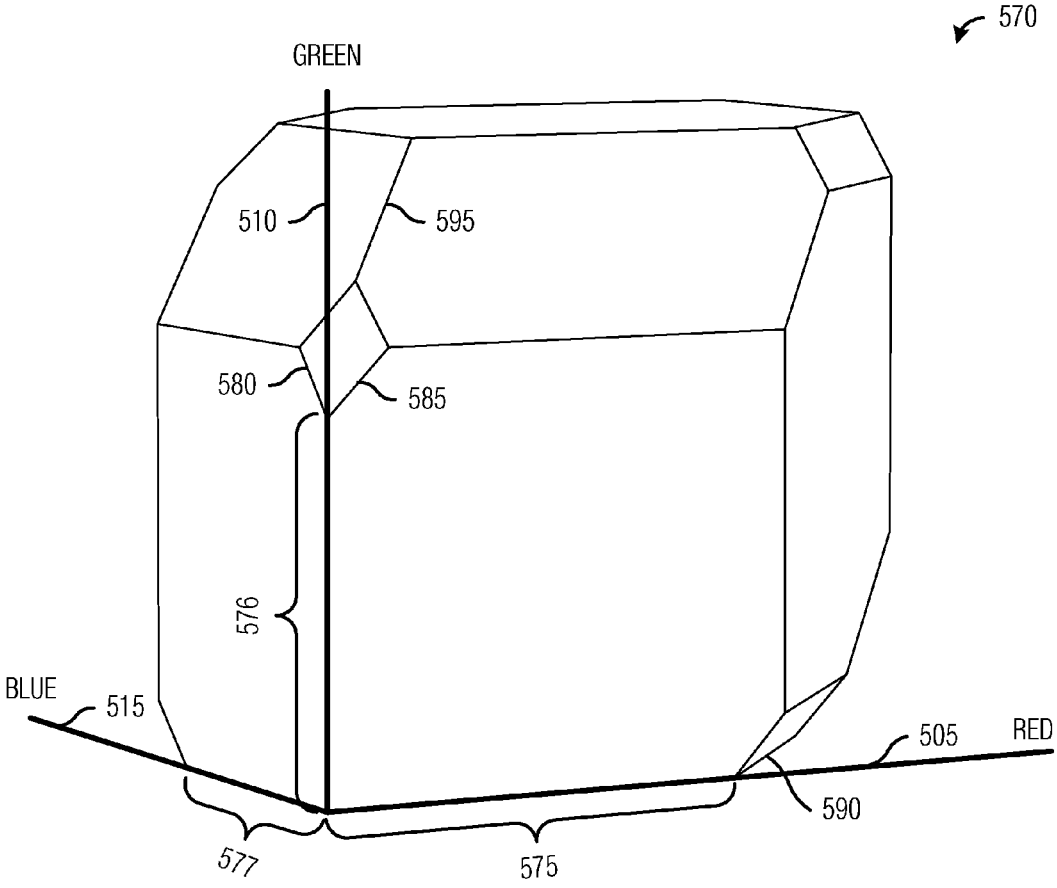
FIG. 5*c* is a diagram of a color-polyhedron of a seven-color RGBCMYW sequential color display system.

Sequential color display systems with a larger number of colors, such as a seven-color RGBCYMW sequential color display system, may have similar geometric shapes representing the displayable colors of the respective sequential color display system. FIG. 5*c* displays a color-polyhedron 570 representing the displayable colors of a seven-color RGBCYMW sequential color display system. The dimensions of the color-polyhedron 570 may be used to determine characteristics of a color sequence used to provide colored light for pixels lying within the color-polyhedron 570. For example, the lengths of the color-polyhedron 570 along the three color axes 505, 510, and 515 (shown as spans 575, 576, and 577) may specify a light intensity range for each of the three colors red, green, and blue. Similarly, dimensions of other edges on the color-polyhedron 570 may be used to determine the color sequence characteristics for the remaining four colors, CYMW.

An edge 580 of the color-polyhedron 570 on a surface normal to the green color axis 510 and the blue color axis 515 may specify a light intensity range for the color cyan (C). Similarly, an edge 585 on a surface normal to the red color axis 505 and the green color axis 510 may specify a light intensity range for the color yellow (Y) and an edge 590 may specify a light intensity range for the color magenta (M), while an edge 595 may specify a light intensity range for the color white (W).

Although FIGS. 5*a* through 5*c* illustrate color-polyhedrons for a three-color RGB and a seven-color RGBCYMW sequential color display system, similar color-polyhedrons may be illustrated for sequential color display systems of different numbers of colors and different specific colors. For example, two-color, three-color, four-color, five-color, six-color, seven-color, and greater may all have color-polyhedrons. Other examples of sequential color display systems may include CYM, RGBW, CYMW, RGBCYM, and so forth. Therefore, the discussion of three-color RGB and seven-color RGBCYMW sequential color display systems should not be construed as being limiting to either the scope or the spirit of the embodiments.

With reference back to FIG. 4*b*, the sequence generator 440 may receive from the color sequence reallocation unit 435 information related to the reallocated color sequence. For example, the color sequence reallocation unit 435 may provide to the sequence generator 440 a percentage of a color sequence allocated to each color in a color sequence, i.e., the color sequence reallocation unit 435 may provide to the sequence generator 440 duty cycles for each color in a color sequence.

Figure 6:
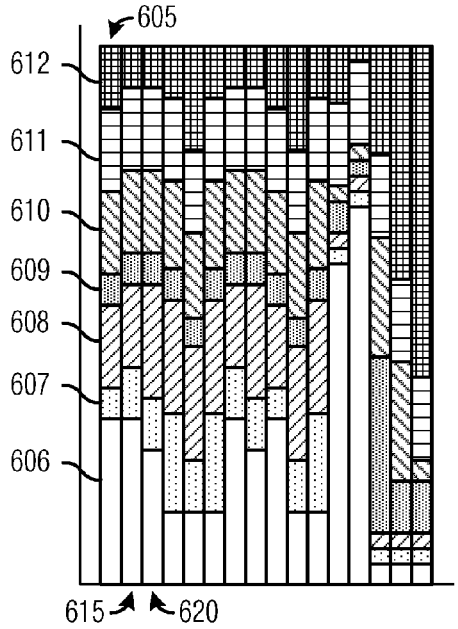
FIG. 6 is a diagram of duty cycles of color sequences.

Since the color sequence reallocation may be based on each image's color histogram, a first color sequence for a first image may be different from a second color sequence for a second image. FIG. 6 illustrates color sequences, such as color sequences 605, 615, and 620 for an exemplary sequence of images from a video stream displayed in a seven-color RGBCYMW sequential color display system. For each color sequence, FIG. 6 illustrates a percentage allocated to different colors in the color sequence. For example, for the color sequence 605, a first percentage 606 may be allocated to a first color, a second percentage 607 may be allocated to a second color, and a third percentage 608 may be allocated to a third color. Similarly, a fourth percentage 609, a fifth percentage 610, a sixth percentage 611, and a seventh percentage 612 may be assigned to fourth through seventh colors. The first through seventh percentages 606 through 612 may add up to be about 100 percent of the color sequence 605.

With reference back to FIG. 4*b*, the sequence generator 440 may include a color cycle order unit 442 that may be used to assign an order to the display of colors in a color sequence. The ordering of the display of colors may be based on the percentage allocation for each color in a color sequence. The ordering of the display of colors also may be based on reducing color separation artifacts, impact the quality of images displayed.

After the color cycle order unit 442 assigns an order to the display of colors in a color sequence, a color bitplane assignment unit 444 may be used to assign the displaying of actual pixels in an image to specific display times in a color sequence. As with the color cycle assignment, the assignment of pixels to specific display times may have an impact on the quality of the image being displayed. For example, to reduce pulse-width modulation artifacts, the displaying of different colors and bit-weights should be distributed throughout the color sequence. Furthermore, for a given pixel, it may be desirable to concentrate as much of the pixel's energy towards a center of the color sequence as possible. This may help to reduce dramatic shifts in display energy due to small changes in color percentage allocations.

Once assigned by the color bitplane assignment unit 444, the color sequence may be provided to the light source 410. The light source 410 may use the color sequence to determine when to display different colors. The color sequence may also be used to determine the loading of image data corresponding to a color of light being produced by the light source 410 into the microdisplay 405.

Since each color sequence may be significantly different from color sequences that precede it and color sequences that succeed it, a single rigid color sequence may not be able to provide sufficient flexibility in the assignment of the color cycle and the bitplanes to help reduce visible artifacts.

Figure 7:
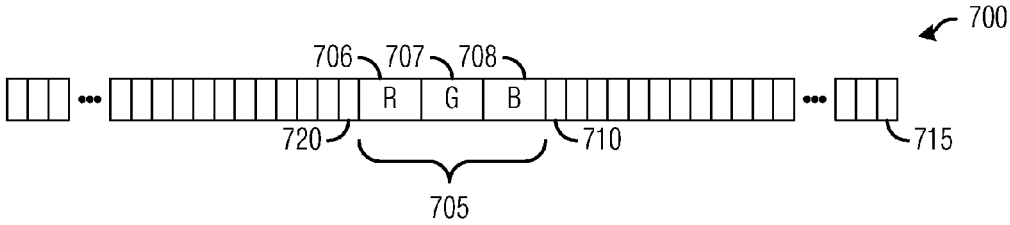
FIG. 7 is a diagram of a structure of a color sequence.

FIG. 7 illustrates a structure of a color sequence 700 permitting a high degree of flexibility and adaptivity in the assignment of color cycles and bitplanes to help reduce visible artifacts. The color sequence 700 may be used to display an entire image or one of two fields of an image. When used to display one field of a two-field image, the color sequence 700 may be repeated to display a second field of the two-field image. The color sequence 700 may include a center portion 705 that includes color display times that may be reserved for displaying smaller bit-weights of light. The center portion 705 may include display times for some or all of the colors used in a sequential color display system. For example, the color sequence 700 shown in FIG. 7 includes color display times for displaying colors R (display time 706), G (display time 707), and B (display time 708). Alternate embodiments of the color sequence 700 may include color display times for other colors. For example, in a seven-color RGBCYMW sequential color display system, the center portion 705 may include color display times for some or all of the seven colors. The colors displayed in the center portion 705 may be dependent on colors present in the sequential color display system's light source, the number of colors in the sequential color display system, and so forth.

The color sequence 700 may also include a plurality of display time blocks, such as display time blocks 710, 715, and 720. Preferably, the display time blocks 710 through 720 may be small in duration, on the order of the display times for the less significant bit-weights, and about equal in duration. For example, the display time blocks 710 through 720 may be about equal in duration to a display time of a least significant bit-weight or a second to least significant bit-weight. Durations of the display time blocks 710 through 720 that may be too large may result in wasted display times when only a small bit-weight is to be displayed, for example. A single color may be assigned to each display time block 710 through 720 and a single bit or several small bits may be displayed during a single display time block.

The display time blocks 710 through 720 may be substantially equally distributed about the center portion 705 and the ordering of the color cycle may begin with display time blocks that are closest to the center portion, such as display time blocks 710 and 720. The ordering of the color cycle may then progress away from the center portion 705 until all colors have been allocated.

The color percentages for each color in a color sequence may then be partitioned into an integral number of display time blocks and then distributed over the different display time blocks of the color sequence 700. If the partitioning of the color percentages for each color results in one or more display times that do not fully consume a display time block, then the fractional display time may be displayed using the center portion 705.

Figure 8A:
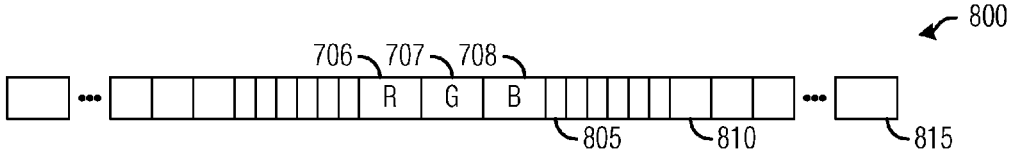
FIGS. 8*a* through 8*c* are diagrams of structures of color sequences.

In an alternative embodiment, rather than having a single duration for the display time blocks 710 through 720, each of the display time blocks 710 through 720 may have one of several different durations, where the number of different durations may be significantly smaller than the number of display time blocks. FIG. 8*a* illustrates a structure of a color sequence 800 where there are three different durations for the display time blocks in the color sequence 800. A first display time block, such as display time block 805, may have a shortest duration, a second display time block, such as display time block 810, may have a medium duration, and a third display time block, such as display time block 815, may have a longest duration. The use of display time blocks with several different sizes may enable an optimization of the distribution of the color percentages for the colors in the color sequence to minimize a need to partition color percentages over a non-integral number of display time blocks.

Figure 8B:
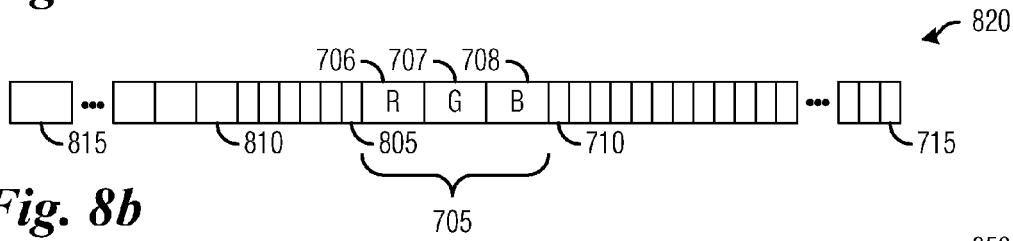
Figure 8C:
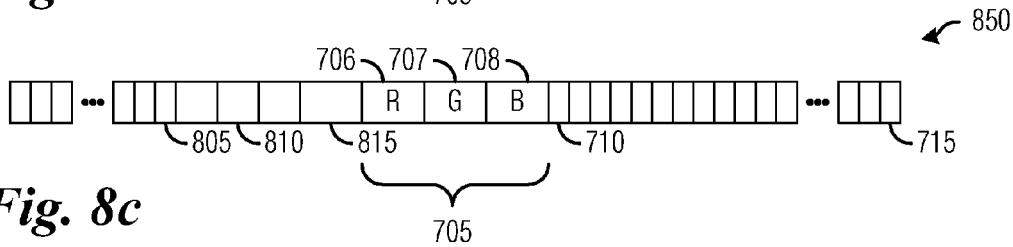

FIG. 8*b* illustrates a structure of a color sequence 820, wherein display time blocks on a first side of the center portion 705, a right side of the center portion 705, are all about the same duration. Display time blocks on a second side of the center portion 705, a left side of the center portion 705, may each have one of several different durations. FIG. 8*c* illustrates a structure of a color sequence 850, wherein each display time block may have one of several different durations. However, an ordering of the display time blocks may be changed so that the longer duration display time blocks, such as the display time blocks 810 and 815, may be placed closer to the center portion 705.

Although shown in FIGS. 8*b* and 8*c* as having the longer duration display time blocks on a left side of the center portion 705, alternative color sequences may have the longer duration display time blocks on a right side of the center portion 705. Furthermore, while FIGS. 8*a* through 8*c* illustrate color sequences wherein the display time blocks outside of the center portion 705 are displayed as increasing or decreasing monotonically away from the center portion 705, alternative color sequences may have the different duration display time blocks distributed so that there is not a monotonic relationship in the duration of the display time blocks. Therefore, the diagrams and associated discussions should not be construed as being limiting to either the scope or the spirit of the embodiments.

Figure 9:
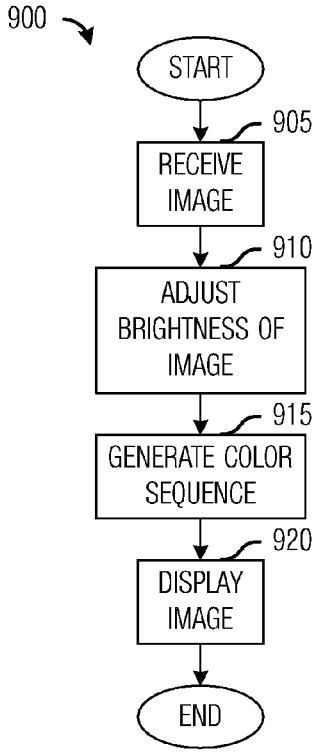
FIG. 9 is a diagram of a sequence of events in displaying an image.

FIG. 9 illustrates a sequence of events 900 in the displaying of an image in a sequential color display system. The displaying of an image in the sequential color display system 400 may begin with a receiving of the image to display (block 905). The image may be a part of a stream of images provided by an input port connected to a signal source, such as a DVD player, magnetic tape player, over-the-air broadcast signal, satellite broadcast signal, data network distributed video stream, and so on. The image may then have its brightness adjusted to potentially increase the brightness of the image (block 910).

The adjustment of the brightness of the image may be performed by computing duty cycles for each color in a color sequence of the sequential color display system. The computing of the duty cycle may be based on actual display color intensities needed to display the image rather than simply utilizing a color sequence that provides an entire displayable range of colors in the sequential color display system. The computing of the duty cycle may make use of linear program solving techniques to produce an optimal solution or a deterministic approximation to produce a sub-optimal solution.

After the duty cycle has been computed, a reallocating of a color sequence used to display the image so that the color intensities displayed by the color sequence are actual pixel color intensities in the image may be performed. This may free up some display time in the color sequence, which may be reallocated to increase display times of color intensities that are actually used, thereby increasing the brightness of the image. The reallocation of a color sequence, and thereby the brightness of the image, may be performed by the color sequence reallocation unit 435 of the sequential color display system 400. The brightness of the image may be further increased if clipping of some of the pixels with higher color intensities is permitted. Refer to co-assigned patent application entitled "System and Method for Image-based Color Sequence Reallocation," filed Sep. 7, 2007, Ser. No. 11/851,916, for a detailed description of the adjusting of the brightness of the image.

After the brightness of the image has been adjusted by computing duty cycles of each color in the color sequence and reallocating a color sequence based on computed duty cycles of each displayed color, a reallocated color sequence may be generated (block 915). The generation of the reallocated color sequence may involve the ordering of the colors in the color sequence, the partitioning of large contiguous blocks of a single color in multiple small blocks that may be mixed with blocks of other colors to help reduce visual artifacts, and so on. Each color may be displayed in a contiguous block or the individual colors may be partitioned into smaller blocks of time and then mixed to help reduce visual noise and color artifacts. With the reallocated color sequence generated, the image may then be displayed (block 920). Due to the sequential nature of the display system, the displaying of the image may occur in sequence. When the reallocated color sequence causes a light of particular color and intensity to be produced by a light source, a microdisplay, such as the microdisplay 405, may be loaded with image data associated with the particular color of light and intensity. As the colors and intensity change, the microdisplay 405 may be loaded with corresponding image data.

Figure 10:
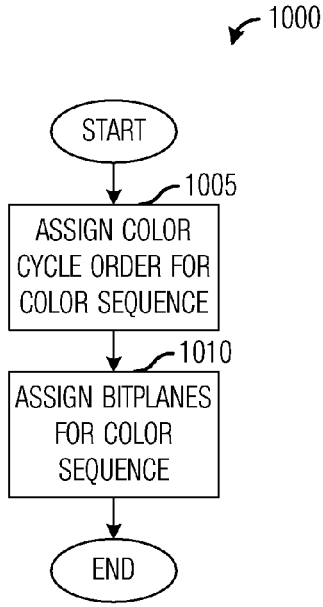
FIG. 10 is a diagram of a sequence of events in generating a color sequence.

FIG. 10 illustrates a sequence of events 1000 in the generation of a color sequence for an image being displayed in a sequential color display system. The sequence of events 1000 may be an implementation of the generation of a reallocated color sequence, block 915 (FIG. 9). The generation of a reallocated color sequence may begin with an assignment of a color cycle order for the reallocated color sequence (block 1005). It may be desired to have a highly effective color cycle rate to help reduce or prevent color separation artifacts. Furthermore, the colors of the color cycle should be distributed as evenly as possible to help prevent or reduce pulse-width modulation artifacts, which may be noticeable in images displayed using poorly designed color cycles. Additionally, the color cycle should be designed so that there are no drastic shifts in energy when there are small changes in color sequence percentages.

After the color cycle order has been assigned, the bitplanes of the image may be assigned (block 1010). The assignment of the bitplanes should be performed so that as much of a pixel's energy is concentrated towards the middle of the reallocated color sequence as possible. This may help to reduce pulse-width modulation artifacts as well as drastic changes in energy with small changes in color sequence percentage. Once the assignment of the bitplanes is complete, then the reallocated color sequence is complete.

Figure 11A:
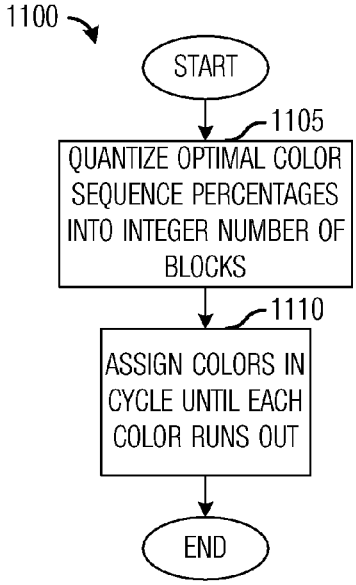
FIGS. 11*a* and 11*b* are diagrams of sequences of events in assigning color cycle order for color sequences.

FIG. 11*a* displays a sequence of events 1100 in the assignment of colors in a color cycle. The sequence of events 1100 may be an implementation of the assignment of the color cycle order, block 1005 (FIG. 10). The assignment of the color cycle order may begin with a quantization of the color sequence percentages (also referred to as color duty cycles) into an integral number of display time blocks, such as the display time blocks 710 through 720 (block 1105). If the color sequence percentages do not divide evenly into an integer number of display time blocks, a remainder of the color sequence percentages may be displayed in a center portion, such as the center portion 705, of the reallocated color sequence.

The colors in the color sequence may then be assigned in a cyclical fashion starting at the display time blocks adjacent to the center portion 705 and working away from the center portion until each colors run out (block 1110). The color cycles may be repeated until all colors run out. For example, in a seven-color RGBCYMW sequential color display system, a possible assignment order for the display of colors may be to cycle through the seven colors (RGBCYMW) with a dropping of colors once all pixels requiring the color have been displayed. An exemplary color sequence may have a display color order of: RGBCMYW, RGBCMYW, RGCM, RGC, RG, RG, R, R, R, R. In the exemplary color sequence, after two complete seven-color cycles, the colors B, Y, and W are not displayed in a third color cycle, while in a fourth color cycle, the color M is dropped, and so on. In color cycles seven through ten, only the color R is displayed.

Figure 11B:
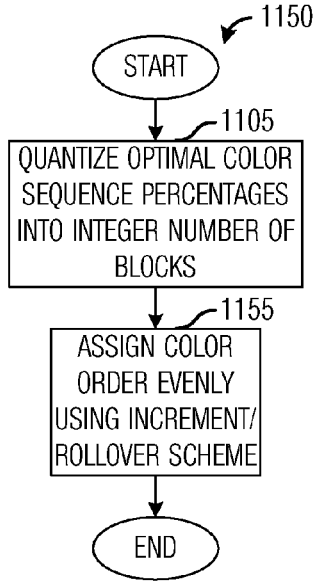

FIG. 11*b* displays a sequence of events 1150 in the assignment of colors in a color cycle. The sequence of events 1150 may be an alternative embodiment of the assignment of the color cycle order, block 1005 (FIG. 10). The assignment of the color cycle order may begin with a quantization of the color sequence percentages into an integral number of display time blocks (block 1105). The colors in the color sequence may then be assigned evenly using an increment/rollover scheme (block 1155).

The increment/rollover scheme may be described as follows: Given a seven-color RGBCYMW color sequence {r g b c m y w} which adds up to a value of one (1); initialize seven buckets labeled {Br Bg Bb Bc Bm By Bw} so that each bucket is equal to zero (0); then, for each assignable bitplane, add each color's duty cycle (percentage of the color sequence) to the color's bucket; select a bucket with a maximum value and assign the selected bucket's color to the bitplane and subtract one (1) from the selected bucket. For example, if the duty cycles are {0.25 0.25 0.2 0.1 0.1 0.05 0.05} and there are 20 assignable bitplanes, then the color cycle order may be assigned as: 1 2 3 4 5 1 2 3 6 1 2 7 3 1 2 4 5 3 1 2, where red=1, green=2, blue=3, cyan=4, magenta=5, yellow=6, and white=7.

Figure 12:
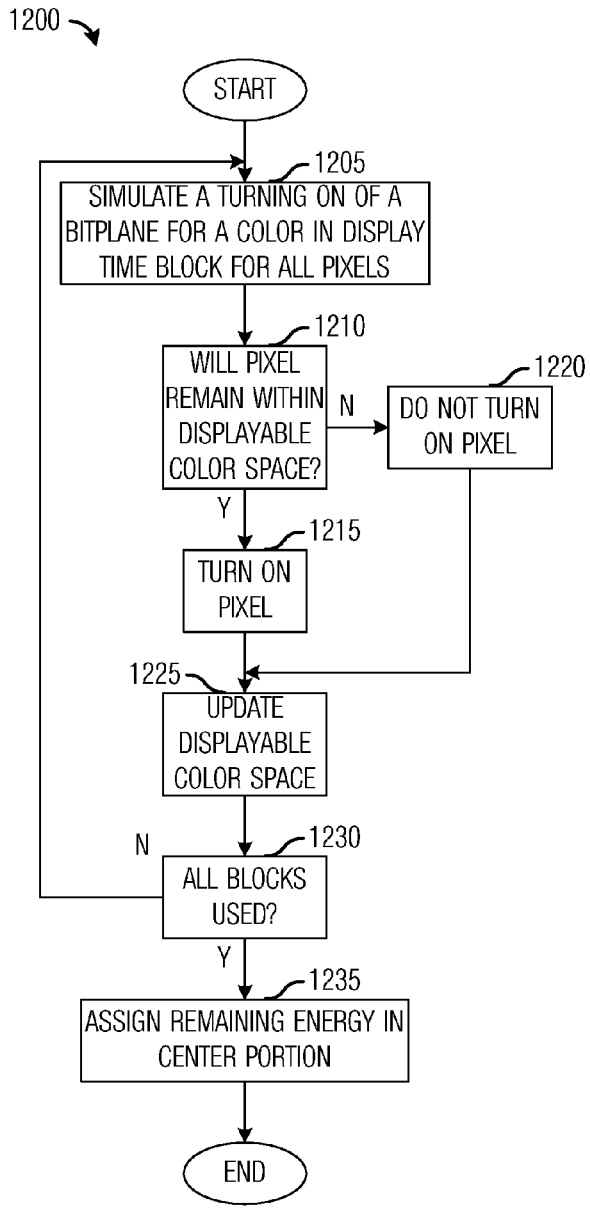
FIG. 12 is a diagram of a sequence of events in assigning bitplanes for color sequences.

FIG. 12 displays a sequence of events 1200 in the assignment of bitplanes of a color sequence for the display of an image being displayed in a sequential color display system. The sequence of events 1200 may be an implementation of the assignment of bitplanes of the image, block 1010 (FIG. 10). The assignment of bitplanes may begin with an attempt to turn on a bitplane for a color assigned to a display time block (block 1205). The assignment only concerns pixels making use of the color assigned to the display time block. For example, if a bitplane being assigned is for a display time block that has been assigned to the color red, then only pixels making use of the colors red, yellow, magenta, and white will be examined.

For each pixel, a determination is made as to whether the turning on of the pixel during the display time block will keep the pixel within an available color space of the sequential color display system (block 1210). If it will, then the pixel will be turned on during the display time block (block 1215).

If it will not, then the pixel will be turned off during the display time block (block 1220). Once all of the pixels have been tested and set to be turned on or off during the display time block, then the available color space of the sequential color display system may be updated to reflect the effect on the available color space of the display time block (block 1225).

A check may then be made to determine if all display time blocks have been used (block 1230). If not all display time blocks have been used, then the sequence of events 1250 may be repeated for all remaining display time blocks. If all display time blocks have been used, then any remaining pixels to be displayed may be assigned for display in a center portion of the color sequence (block 1235). The assignment of the remaining pixels may be performed using a spatial-temporal multiplexer (STM). STM is a dithering technique to help increase the perceived bit resolution that employs high frequency dither patterns (in space and time) to minimize perceived noise.

Figure 13:
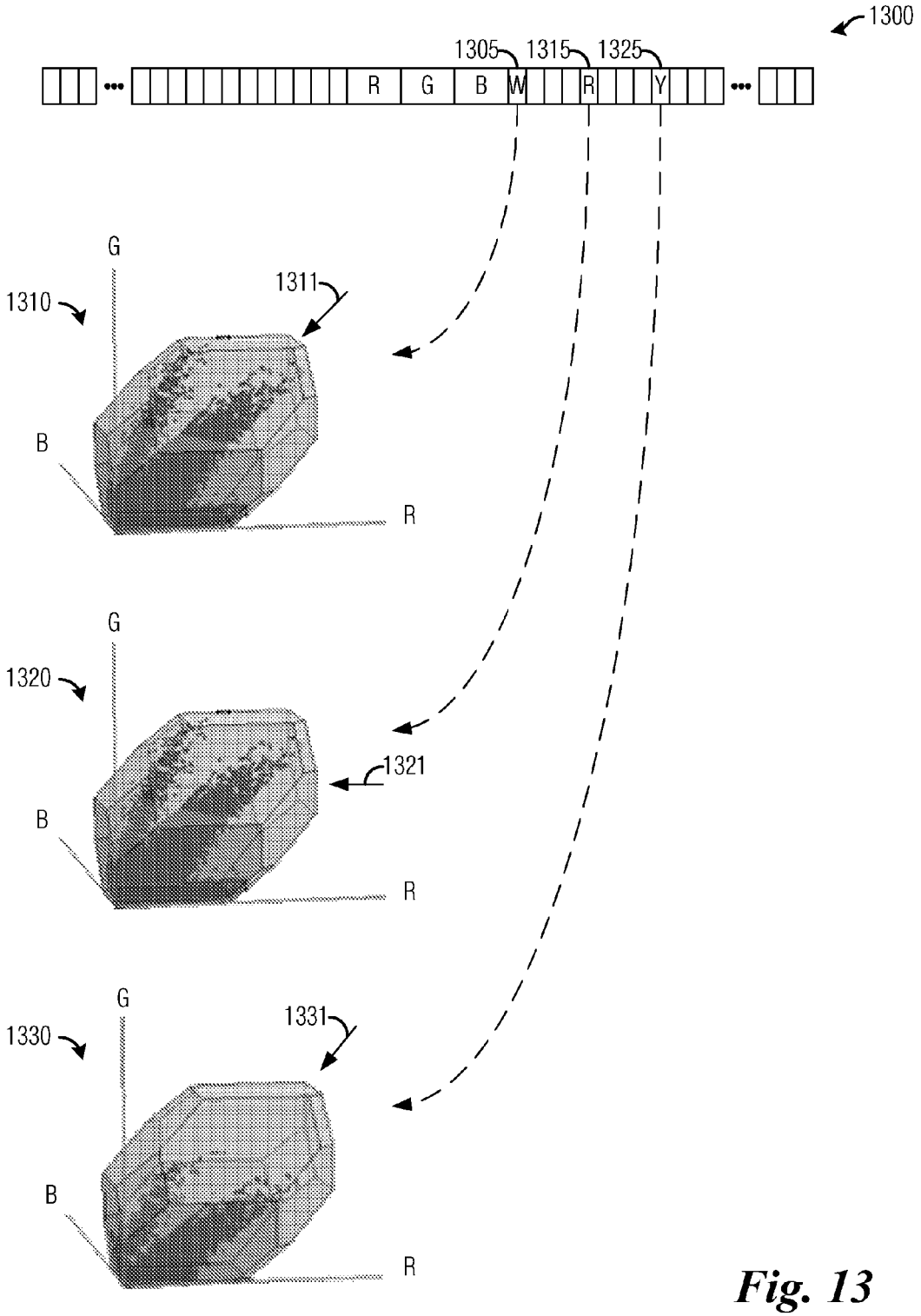
FIG. 13 is a diagram of the effects of bitplane assignment.

FIG. 13 displays the effects of bitplane assignment on pixels of an image being displayed in a sequential color display system. FIG. 13 displays a color sequence 1300 with emphasis on certain display time blocks, such as display time block 1305, 1315, and 1325. Display time block 1305 has been assigned to display a color white (W), display time block 1315 has been assigned to display a color red (R), and display time block 1325 has been assigned to display a color yellow (Y).

The display of pixels containing the color white during the display time block 1305 may have a net effect of reducing an available color space (shown as color-cube 1310) of the sequential color display system along a line 1311 with axial components proportional to the contributions of the colors red, green, and blue to the color white. The display of pixels containing the color white during the display time block 1315 may have a net effect of reducing the available color space (shown as color-cube 1320) of the sequential color display system along a line 1321, which may be parallel to an axis representing the color red. The display of pixels containing the color white during the display time block 1325 may have a net effect of reducing the available color space (shown as color-cube 1330) of the sequential color display system along a line 1331 with axial components proportional to the contributions of the colors red and green to the color yellow. As more display time blocks in the color sequence 1300 are displayed, the pixels move closer to an origin of the available color space.

Figure 14:
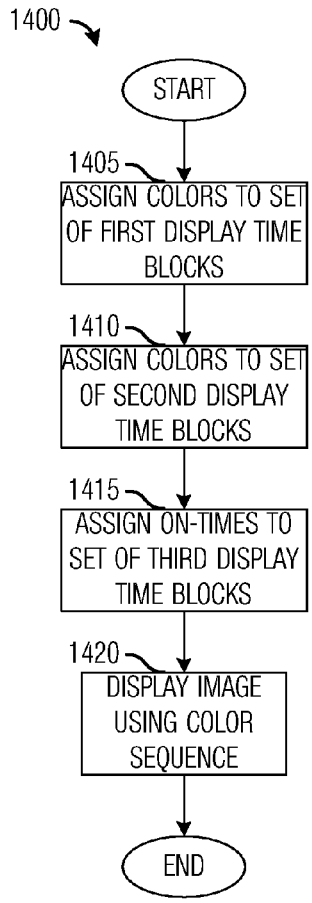
FIG. 14 is a diagram of a sequence of events in assigning colors to display time blocks for color sequences.

FIG. 14 illustrates a sequence of events 1400 in displaying an image. The displaying of an image may begin with an assigning of colors to a set of first display time blocks (block 1405). The set of first display time blocks may be display time blocks on a first side of the center portion 705 of a color sequence, such as display time blocks 710 and 715. If an on-time of a color assigned to a display time block is longer than an on-time of the display time block, then the on-time of the color may be adjusted to compensate for the on-time of the display time block and then the color may be assigned to another display time block with the adjusted on-time. This may be repeated until the on-time of the color has been reduced to about zero (0) or less than any available display time block's on-time. If this occurs, then the color may be retained to assignment to a display time block with pre-assigned colors, such as display time blocks in the center portion 705.

The colors assigned may be based on image data of the image to be displayed. This may be followed by assigning colors to a set of second display time blocks (block 1410). The set of second display time blocks may be display time blocks on a second side of the center portion 705 of a color sequence, such as display time block 720. Then, on-times of display time blocks of a set of third display time blocks may be assigned, wherein each display time block of the set of third display time blocks may already have a pre-assigned color (block 1415). With each display time block assigned, the color sequence may then be used to display an image (block 1420).

In embodiments with color sequences with first display time blocks and second display time blocks with differing display durations, display time blocks with greater display durations should be assigned prior to display time blocks with lesser display durations. Furthermore, colors with greater energy should be assigned before colors with lesser energy.

Alternatively, the assignment of colors may alternate between the assigning of colors to display time blocks of the first set of display time blocks and display time blocks of the second set of display time blocks. This may result in a better distribution of colors in the color sequence.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for displaying an image in a sequential color display system having a given available maximum light intensity for each color to be displayed, the method comprising:

in an apparatus:

receiving image data defining intensities for each color for each pixel of the image to be displayed;

determining a maximum display light intensity needed for each color to display substantially all the pixels of the image with the intensities as defined by the image data;

based on relative values of the determined maximums, determining a relative portion of total display time needed for each color to display all the pixels;

providing a bitplane color sequence with the determined relative total display time portions for the colors distributed over different bit-weight display time blocks across the total display time; and displaying the image using the provided bitplane color sequence;

wherein, when at least one color has a determined maximum less than the given available maximum for that color, at least a part of the portion of the total display time needed for display of that color with a determined maximum equal to the given available maximum is reallocated.

2. The method of claim 1, wherein providing the color sequence includes:

assigning a color cycle order to display time blocks in the color sequence, and assigning bitplane states for each display time block in the color sequence.

3. The method of claim 2, wherein the assigning of the color cycle order comprises:

quantizing the display time portion into an integer number of display time blocks; and cyclically assigning colors in the color cycle.

4. The method of claim 3, wherein a color cycle comprises a cycle of unique colors displayable by a light source, and wherein the cyclically assigning comprises:

sequentially assigning a first color in the color cycle to a display time block in the color sequence;

repeating the sequential assigning for all remaining colors in the color cycle; and dropping a color from the color cycle when there are no more pixels of the color in the image.

5. The method of claim 4, wherein the cyclical assigning further comprises repeating the sequential assigning of the first color, the repeating the sequential assigning for all remaining colors, and the dropping of the color for remaining display time blocks.

6. The method of claim 2, wherein the assigning of the color cycle order comprises:

quantizing the display time portion into an integer number of display time blocks; and assigning colors in the color cycle evenly using an increment and rollover scheme.

7. The method of claim 2, wherein the assigning of the bitplane state comprises:

simulating a turning on of all pixels requiring the displaying of a color assigned to a display time block of the color sequence;

for each pixel, leaving the pixel on in response to a determining that the displaying of the pixel will result in the pixel remaining in a displayable color space, and turning the pixel off in response to a determining that the displaying of the pixel will result in the pixel not remaining in the displayable color space; and updating the displayable color space.

8. The method of claim 7, wherein any pixels remaining to be displayed are displayed in a portion of the color sequence wherein blocks of a number of display time blocks are permanently assigned to display specified colors.

9. The method of claim 8, wherein an energy displayed during a display time block is related to a number of pixels displayed during the display time block, and wherein higher energy display time blocks are located closer to a middle of the color sequence.

10. The method of claim 7, further comprising, after the updating, repeating the turning on, the leaving the pixel on or the turning the pixel off, and the updating for remaining display time blocks of the color sequence.

11. A method for generating a color sequence for driving a light source having given available maximum light intensities of respective different colors, the method comprising:

in an apparatus:

based on image data defining intensities for each color for each pixel of an image to be displayed, determining a maximum display light intensity needed for each color to display substantially all the pixels of the image with the intensities as defined by the image data;

based on relative values of the determined maximums, determining a relative portion of total display time needed for each color to display all the pixels; and generating a color sequence with the determined relative total display time portions for the colors distributed over different display time blocks across the total display time, including:

assigning a color to be provided by the light source to each first display time block in a set of first display time blocks of the color sequence, wherein a color assigned to a first display time block in the set of first display time blocks is assigned during run-time;

assigning a color to be provided by the light source to each second display time block in a set of second display time blocks of the color sequence, wherein a color assigned to a second display time block in the set of second display time blocks is assigned during run-time; and assigning an on-time for a specified color of light associated with a third display time block in a set of third display time blocks of the color sequence, wherein a specified color is assigned to a corresponding third display time block before run-time; and providing the color sequence to the light source to provide light for use in displaying the image.

12. The method of claim 11, wherein each first display time block and each second display time block has a corresponding on-time, and wherein the assigning of a color to each first display time block and the assigning of a color to each second display time block comprises:

assigning an assignable color to an assignable display time block; and adjusting an on-time of the assignable color.

13. The method of claim 12, further comprising, after the adjusting:

repeating the assigning of the assignable color and the adjusting if the on-time of the assignable color is greater than or equal to an on-time of any first display time block or any second display time block; and assigning the assignable color to a third display time block in the set of third display time blocks if the on-time of the assignable color is less than an on-time of any first display time block or any second display time block.

14. The method of claim 11, wherein an on-time of a first display time block is substantially equal to an on-time of a second display time block.

15. The method of claim 11, wherein the assigning of a color to each first display time block and the assigning of a color to each second display time block comprises assigning colors with greater energy before assigning colors with lesser energy.

16. The method of claim 15, wherein an ordering of display time blocks of the color sequence is first display time blocks followed by third display time blocks and second display time blocks, wherein the colors with greater energy are assigned to first display time blocks and second display time blocks that are closer to the third display time blocks than colors with lesser energy.

17. The method of claim 11, wherein the first display time blocks in the set of first display time blocks and the second display time blocks in the set of second display time blocks may have one of several on-times, and wherein the assigning of a color to a first display time block and the assigning of a color to a second display time block comprises assigning first assigning colors with largest on-times to first display time blocks and second display time blocks with largest on-times.

18. A display system comprising:

a light source having given available maximum light intensities of respective different colors;

a light modulator optically coupled to the light source and positioned in a light path of the light source, the light modulator configured to produce images on a display plane by modulating light from the light source based on image data defining intensities for each color for each pixel of an image to be displayed; and a controller electronically coupled to the light modulator and the light source, the controller configured to load image data into the light modulator and to provide a color sequence to the light source, the controller comprising a sequence generator configured to assign a color cycle order to the color sequence based on the image data and to assign bitplane states for image data including:

determining a maximum display light intensity needed for each color to display substantially all the pixels of the image with the intensities as defined by the image data;

based on relative values of the determined maximums, determining a relative portion of total display time needed for each color to display all the pixels; and providing a bitplane color sequence with the determined relative total display time portions for the colors distributed over different bit-weight display time blocks across the total display time wherein, when at least one color has a determined maximum less than the given available maximum for that color, at least a part of the portion of the total display time needed for display of that color with a determined maximum equal to the given available maximum is reallocated.

19. The display system of claim 18, wherein the sequence generator comprises:

a color cycle order unit configured to assign an order to colors to be displayed by the light source; and a color bitplane assignment unit coupled to the color cycle order unit, the color bitplane assignment unit configured to assign the display of pixels in an image to be displayed to specific portions of the color sequence.

20. The display system of claim 18, wherein the display system is a sequential color display system.

21. The display system of claim 20, wherein the light modulator is a digital micromirror device.

* * * * *